US008141966B2

(12) United States Patent
Placke et al.

(10) Patent No.: US 8,141,966 B2
(45) Date of Patent: Mar. 27, 2012

(54) TELESCOPIC PULL-OUT ARRANGEMENT

(75) Inventors: Frank Placke, Bielefeld (DE); Claudia Rupp, Neresheim (DE); Matthias Stahl, Schloß Holte-Stukenbrock (DE); Ulrich van Pels, Rheda-Wiedenbrück (DE)

(73) Assignees: BSH Bosch und Siemens Hausgerate GmbH, Munich (DE); Miele & CIE. KG, Gutersich (DE)

( * ) Notice: Subject to any disclaimer, the term of this patent is extended or adjusted under 35 U.S.C. 154(b) by 282 days.

(21) Appl. No.: 12/525,560

(22) PCT Filed: Jan. 17, 2008

(86) PCT No.: PCT/EP2008/050493

§ 371 (c)(1),
(2), (4) Date: Aug. 3, 2009

(87) PCT Pub. No.: WO2008/095753

PCT Pub. Date: Aug. 14, 2008

(65) Prior Publication Data

US 2010/0066224 A1 Mar. 18, 2010

(30) Foreign Application Priority Data

Feb. 6, 2007 (DE) ..... 10 2007 005 950

(51) Int. Cl.
*A47B 88/00* (2006.01)
*A47B 96/04* (2006.01)

(52) U.S. Cl. ..... 312/334.7; 312/334.5; 312/404

(58) Field of Classification Search ..... 312/334.4, 312/334.5, 334.7, 334.8, 330.1, 348.1; 384/22; 403/187, 192, 331
See application file for complete search history.

(56) References Cited

U.S. PATENT DOCUMENTS

| | | | | |
|---|---|---|---|---|
| 4,598,603 | A * | 7/1986 | Hiramitsu et al. | 74/484 R |
| 5,015,047 | A * | 5/1991 | Nock | 312/334.11 |
| 5,195,779 | A * | 3/1993 | Aoyama et al. | 280/784 |
| 5,632,542 | A * | 5/1997 | Krivec | 312/334.7 |
| 6,367,900 | B1 * | 4/2002 | Woerner | 312/334.5 |
| 6,454,371 | B1 * | 9/2002 | Muterthies et al. | 312/263 |
| 6,712,435 | B2 * | 3/2004 | Kim et al. | 312/319.1 |
| 7,469,979 | B2 * | 12/2008 | Tupper et al. | 312/348.4 |
| 2003/0218409 | A1 * | 11/2003 | Hightower | 312/334.7 |
| 2005/0122015 | A1 * | 6/2005 | Hightower | 312/334.5 |
| 2009/0066207 | A1 * | 3/2009 | Laible | 312/404 |
| 2009/0079312 | A1 | 3/2009 | Laible | |

FOREIGN PATENT DOCUMENTS

| | | | |
|---|---|---|---|
| DE | 102007051343 | A1 * | 4/2009 |
| WO | WO 2006120056 | A1 * | 11/2006 |

* cited by examiner

*Primary Examiner* — David Dunn
*Assistant Examiner* — Ryan A Doyle
(74) *Attorney, Agent, or Firm* — James E. Howard; Andre Pallapies

(57) ABSTRACT

A telescopic pull-out arrangement for a refrigerator is provided that includes two telescopic pull-out mechanisms each provided with a stationary rail on a common frame and a movable rail, and a storage part retained on the movable rails by a pair of identical adapters. The storage part has a first engagement contour cooperating with a first adapter of the couple and a second engagement contour cooperating with the second adapter of the couple. Each adapter is provided with a third and a fourth engagement contour. The first engagement contour of the storage part and the third engagement contour of the first adapter engage into one another with less tolerance transverse to the pull-out direction than the engagement of the second engagement contour of the storage part and the fourth engagement contour of the second adapter engage into one another.

21 Claims, 4 Drawing Sheets

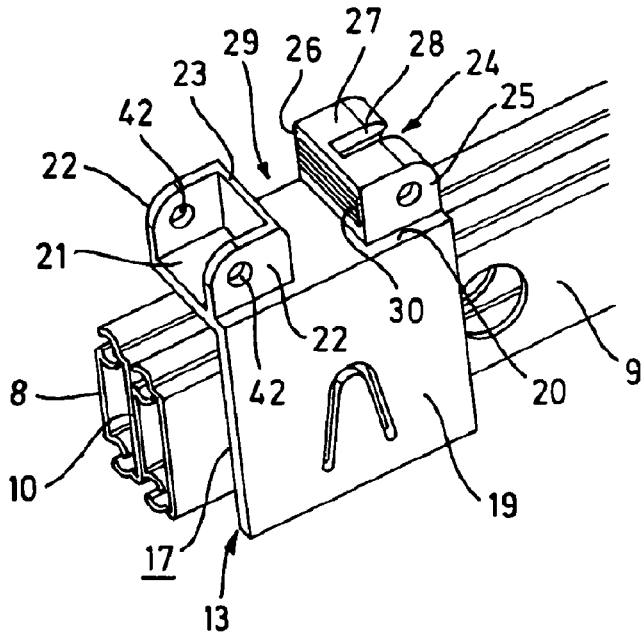
Fig. 3
Fig. 5
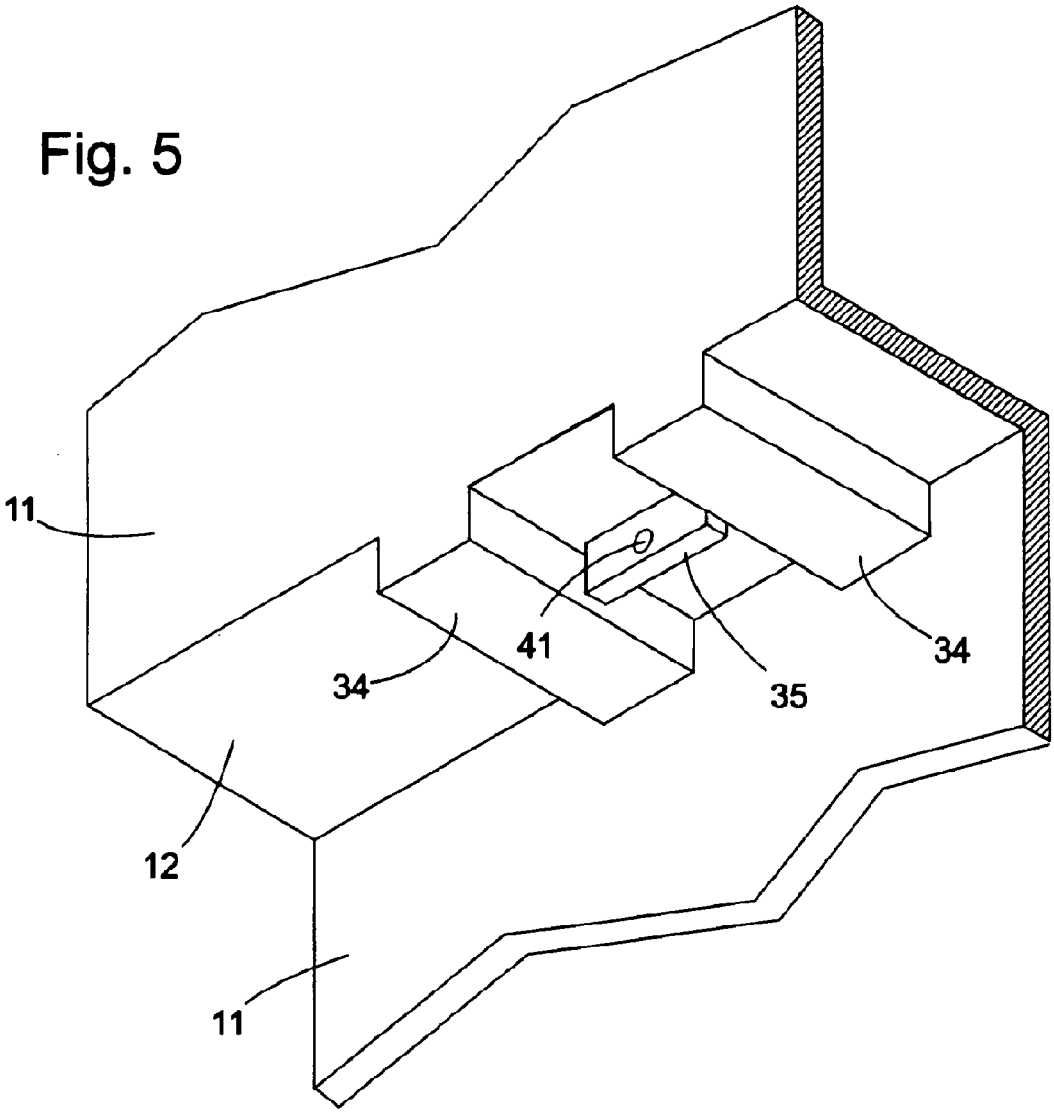

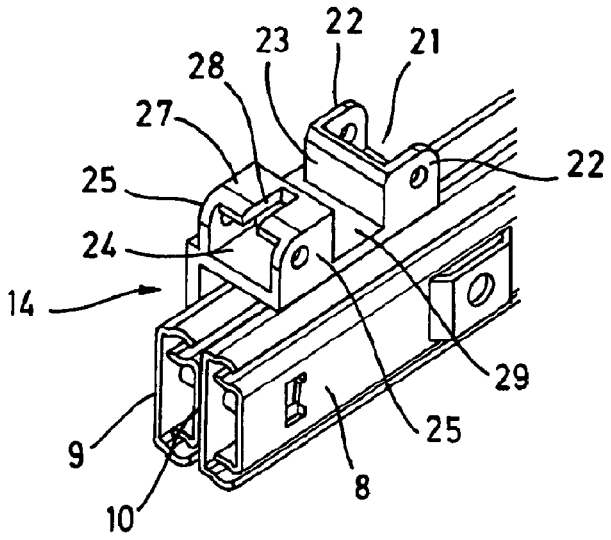
Fig. 4
Fig. 6
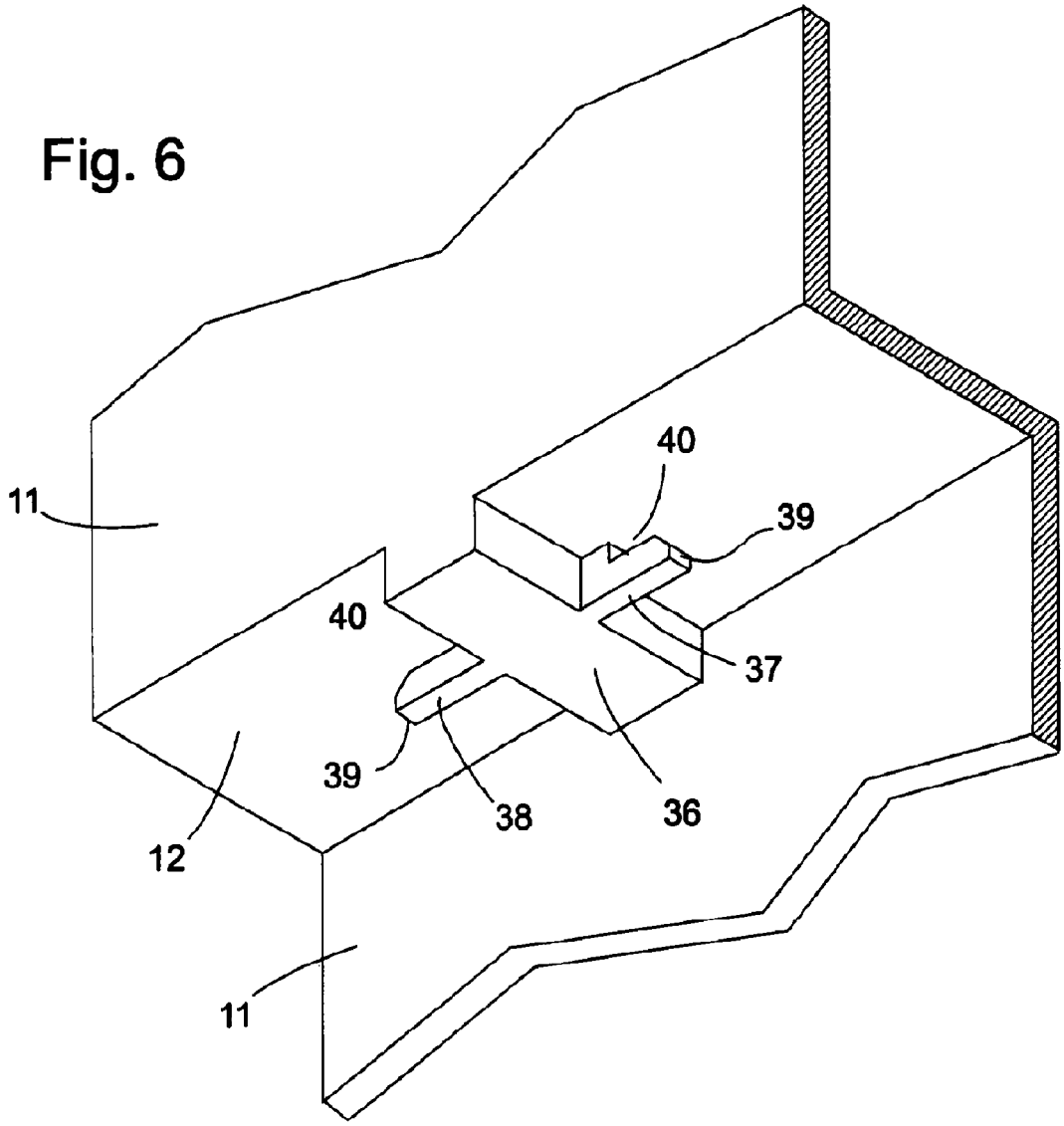

TELESCOPIC PULL-OUT ARRANGEMENT

BACKGROUND OF THE INVENTION

The present invention relates to a telescopic pull-out arrangement comprising two telescopic extension slides, each having a fixed rail and at least one movable rail mounted to a common frame, and a storage section, such as a tray or box, which is held on the movable rails via at least one pair of adapters. Such a telescopic pull-out arrangement, used for retaining and guiding a pull-out box in a refrigerator, is described e.g. in DE 10 2005 021 591 A1.

Telescopic extension slides are known in the form of part extension slides and full extension slides. A part extension slide comprises a pair of rails that can move counter to one another. As the rails must not completely disengage when they are pulled apart, the freedom of movement of the rails of a part extension slide relative to one another is less than their length.

In order to achieve greater freedom of movement, full extension slides are used. These comprise, between a fixed rail and a movable rail provided for supporting a storage section, a second movable rail which is in engagement with the two abovementioned rails. Although an intermediate rail of this kind enables a freedom of movement of the telescopic extension slide to be achieved that is greater than the length of each of its individual rails, when pulled apart the movable rails may also swing back and forth transversely to the pull-out direction, which compromises the stability of the storage section on the telescopic extension slides.

In a telescopic pull-out arrangement with part extension slides supporting the storage section, it can be ensured that the storage section is firmly seated on the rails by using a fixed bearing on one side of the storage section and a movable bearing on the other side. At the fixed bearing, the movable rail and the storage section engage with one another in a form-fit manner so that the position of rail and storage section relative to one another is tightly toleranced. On the movable rail of the other part extension slide, the storage section is supported with transverse play with respect to the pull-out direction, so that manufacturing tolerances in the dimensions of the storage section or in the spacing of the two telescopic extension slides from one another can be compensated.

In telescopic pull-out arrangements with full extension slides, there must likewise be transverse play with respect to the pull-out direction between storage section and at least one of the movable rails in order to compensate for dimensional tolerances. However, this play must be limited in order to ensure that, in the pulled-out configuration, the storage section still rests securely on the rails and cannot slide off. For this purpose adapters, which for cost reasons must be identical on both extension slides, are provided between the movable rails on the one hand and the storage section on the other. If the storage section and adapters engage in one another in a tightly toleranced manner, dimensional tolerances can no longer be compensated. Resultant stressing of the telescopic extension slides in the horizontal direction transversely to the pull-out direction puts considerable wear and tear on the extension slides. However, if transverse play with respect to the pull-out direction is provided between the storage section and the two adapters, the storage section as a whole will no longer be firmly anchored.

BRIEF SUMMARY OF THE INVENTION

The object of the present invention is to resolve this dilemma by creating a telescopic pull-out arrangement with two telescopic extension slides, each having a fixed rail and at least one movable rail mounted to a common frame, and a storage section which is held on the movable rails via at least one pair of adapters, wherein, on the one hand, the storage section can be fixed despite the identicalness of the adapters and, on the other hand, dimensional tolerances can be compensated.

This object is achieved in that, in respect of a first and second engagement contour of the storage section, both adapters of the pair have a third and a fourth engagement contour, the first engagement contour of the storage section and the third engagement contour of the first adapter engage in one another, the second engagement contour of the storage section and the fourth engagement contour of the second adapter engage in one another, and the engagement of the first and third engagement contour transversely to the pull-out direction has less play than the engagement of the second and fourth engagement contour. Preferably, the play between the first and the third engagement contour is so small that these may be regarded as a fixed bearing, while the second and fourth engagement contour together constitute a movable bearing.

The first and the second engagement contour are preferably disposed on the pull-out box mirror-symmetrically to one another in respect of a mirror plane parallel to the pull-out direction.

On each adapter, the third and fourth engagement contour are preferably spaced apart from one another in the pull-out direction. It is thus possible to dispose the adapters at mirror-symmetrically opposite locations on the two telescopic extension slides, and to bring about engagement of the engagement contours of the support section with different engagement contours of the adapters in each case by virtue of the third engagement contour being to the front in the case of one adapter and the fourth engagement contour being to the front in the case of the other adapter.

Preferably the first and second engagement contour are in each case a projection, and the third and fourth engagement contour are recesses of different width accommodating the projection. Although the first and second engagement contour could conversely be recesses and the third and fourth could be projections, this alternative requires more mounting space than the above mentioned.

In order to facilitate assembly of the storage section, the recess of the third engagement contour preferably has a lead-in chamfer.

The recesses can each be open in the pull-out direction in order to allow the support section to be mounted by telescoping of the engagement contours in the pull-out direction.

If the projection of the first engagement contour can be inserted in the recess of the third engagement contour parallel to the pull-out direction, in the inserted position it is advantageously locked in the vertical direction by engagement with an undercut of the recess.

Alternatively, the recesses can also be open in the vertical direction in order to enable the support section to be placed on the telescopic extension slides from above.

In order to fix the storage section and adapter against one another in the pull-out direction, they can each be provided with a fifth or sixth engagement contour.

To save space, the sixth engagement contour can be disposed between the third and the fourth engagement contour.

The first and second engagement contour can be of a piece with the support section. In order to simplify fabrication of the support section, however, it can also be provided that the first and second engagement contour are formed on a molding attached to a main body in order to form the support section together with same.

BRIEF DESCRIPTION OF THE DRAWINGS

Further features and advantages of the invention will emerge from the following description of exemplary embodiments with reference to the accompanying drawings in which:

FIG. 3 is an enlarged view of an adapter mounted on a telescopic extension slide;

FIG. 4 is a view of an adapter identical to the adapter from FIG. 3, mounted on another telescopic extension slide;

FIG. 5 is a first detail view of the pull-out box;

FIG. 6 is a second detail view of the pull-out box;

DETAILED DESCRIPTION OF EXEMPLARY EMBODIMENTS OF THE PRESENT INVENTION

Figure 1:
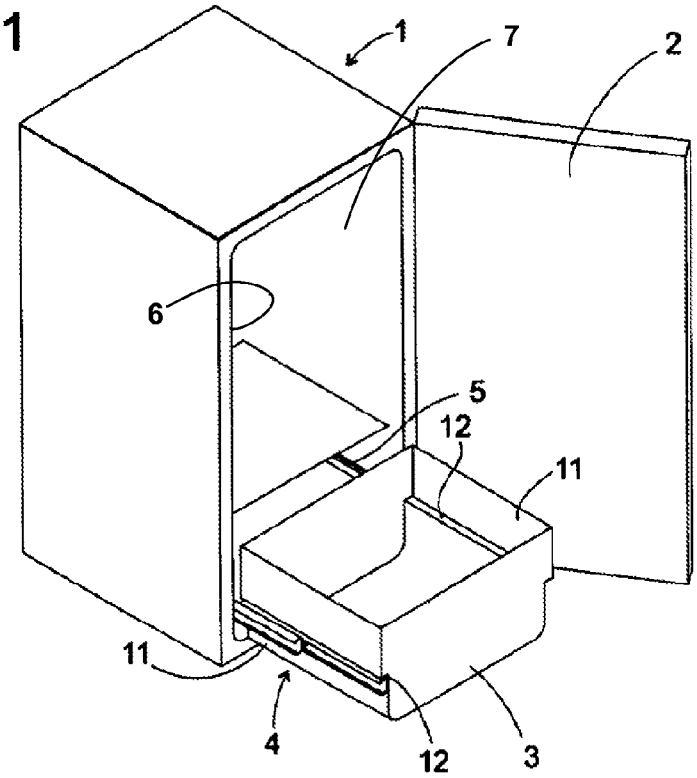
FIG. 1 is a schematic view of a refrigerator with a telescopic pull-out arrangement according to the invention.

FIG. 1 shows a simplified perspective view of a refrigerator with a body 1 and a door 2, in the interior of which is mounted a telescopic pull-out arrangement with a pull-out box 3 shown pulled out. The pull-out box is retained by a left-hand telescopic extension slide 4 and a right-hand telescopic extension slide 5. The telescopic extension slides 4, 5 are implemented here as full extension slides, with a fixed rail 8 anchored to a side wall 6 and 7 respectively of the body 1 (see FIG. 2), a rail 9 supporting the pull-out box 3 and movable therewith, and an intermediate rail 10 which couples the fixed rail 8 and the movable rail 9 to one another. Alternatively, part extension slides could also be used for the telescopic extension slides 4, 5.

The pull-out box 3 has two side walls 11 in which a horizontal shoulder 12 is formed in each case. These shoulders 12 rest on the movable rails 9 of the telescopic extension slides 4, 5. These shoulders 12 must on the one hand be as narrow as possible in order to maximize the capacity of the pull-out box 3; on the other hand, they must be wide enough to ensure secure support of the pull-out box 3 on the telescopic extension slides 4, 5 in spite of any manufacturing tolerances of the pull-out box 3 and of the body 1. For this purpose, the support of at least one of the shoulders 12 on the assigned telescopic extension slide 4 or 5 must have transverse play with respect to the pull-out direction. In order to ensure that the pull-out box 3 cannot fall off in spite of the manufacturing tolerances and particularly in spite of additional play of the movable rails 10 transversely to the pull-out direction in the pulled-out state, two adapters 13, 14, 15, 16 which engage in the contours of the pull-out box 3 are mounted on each of the movable rails 9.

Figure 2:
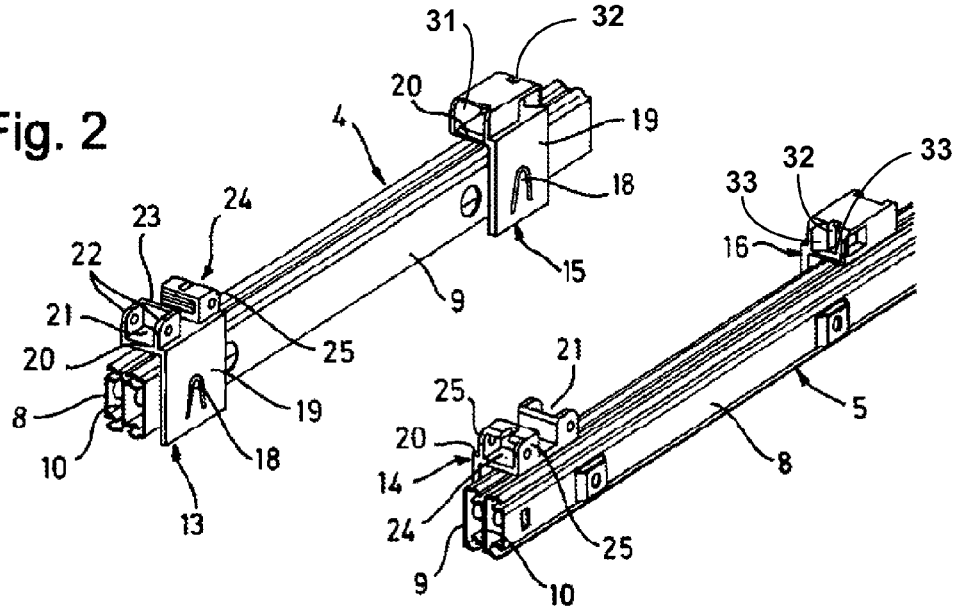
FIG. 2 is a perspective view of two telescopic extension slides of the arrangement according to the invention.

FIG. 2 shows the two telescopic extension slides 4, 5 with the adapters 13 to 16 mounted thereon in the orientation which they assume in relation to one another in the body 1, but without the body 1 and the pull-out box 3, viewed obliquely from the front, i.e. from the direction of the door 2. The two extension slides 4, 5 are mirror-symmetrically opposite one another. Although the positions, on the telescopic extension slides 4, 5, of the pairwise identical adapters 13, 14 and 15, 16 respectively are also mirror-symmetrical, because of their asymmetrical form none of the adapters 13 to 16 is the mirror-image of the one opposite.

The adapters 13 to 16 each have an L-shaped basic body 17 with a vertical leg 19 latched to the movable rail 9 by engagement of a flexible tongue 18, and a horizontal leg 20 extending transversely over the rails 8 to 10. On said horizontal leg are formed a plurality of engagement contours for anchoring the pull-out box 3.

The adapter 13 shown enlarged in FIG. 3 has, on its side facing the door, an engagement contour in the form of a niche 21 which is open to the top and to the front, toward the door, and extends between two side walls 22 over essentially the entire width of the leg 20 and is closed off by a back wall 23. An engagement contour opposite the niche 21 has the form of a box 24 which is open toward the back wall of the body, with side walls 25, a back wall 26 and a cover 27 in which a slot 28 parallel to the pull-out direction is formed. The two back walls 23, 26 delimit a channel 29 running transversely to the pull-out direction. The back wall 26 is provided with latching projections or barbs 30 extending into the channel 29.

The adapter 14, which is identical to the adapter 13, is mounted on the telescopic extension slide 5 in an orientation rotated through 180°, as shown in enlarged form in FIG. 4. Thus, the open side of the box 24 here faces the door and the niche 21 faces the back wall of the refrigerator body 1. The channels 29 of the two adapters 13, 14 are aligned to one another.

On the adapter 15 (see FIG. 2), a box 31 opening toward the door 2 is shown as an engagement contour. Located on the side facing away from the viewer is another engagement contour in the form of a vertical slot 32 open toward the back wall of the body 1. The adapter 16 is again of identical design to the adapter 15 and mounted on the extension slide 5 in an orientation rotated through 180° so that here the slot 32 faces the door 2. The slot 32 is flanked left and right by lead-in chamfers 33.

FIG. 5 shows a fragment of the left-hand side wall 11 of the pull-out box 3, the shoulder 12 of said side wall 11 being visible obliquely from below. Two sturdy cross ribs 34 can be seen which extend transversely to the pull-out direction over the entire width of the shoulder 12, and an intervening narrow longitudinal rib 35 oriented in the pull-out direction. Corresponding ribs 34, 35 are provided mirror-symmetrically to those shown in FIG. 5 on the underside of the right-hand shoulder 12.

The width of at least one of the two cross ribs 34 is dimensioned such that the latter can be inserted from above into the channel 29 of the adapter 13. If the inserted cross rib 34 is the rear one, the longitudinal rib 35 simultaneously engages in the niche 21 with transverse play with respect to the pull-out direction. If the rear cross rib 34 of the right-hand shoulder 12 is simultaneously inserted into the channel 29 of the adapter 14, the right-hand longitudinal rib 35 engages in the slot 28 of the adapter 14. The pull-out box 3 is thus connected to the adapter 14 essentially without play, and any width compensation necessitated by manufacturing tolerances of the body 1 and of the pull-out box 3 is possible due to the engagement, with play, of the left-hand longitudinal rib 35 into the niche 21 of the adapter 13.

FIG. 6 shows a second segment of the underside of the left-hand shoulder 12 of the pull-out box 3. From a sturdy cross rib 36, a narrow ridge 37 extends toward the door 2 and a ridge 38 toward the back wall of the body 1. The tip 39 of each ridge 37, 38 is spaced apart from the underside of the shoulder 12 in each case by a gap 40. Corresponding contours are provided mirror-symmetrically under the right-hand shoulder of the pull-out box.

The tips of the backward directed ridges 38 of the two shoulders 12 can each be inserted from the front, with play, into the box 31 of the adapter 15 and, supported by the lead-in chamfers 33, can be inserted, without play, in the slot 32 of the adapter 16. Thus the pull-out box 3 is again anchored on its right-hand side, without play, transversely to the pull-out direction, and dimensional tolerances of the body 1 and of the pull-out box 3 are compensated by play-retaining engagement in the box 31 of the adapter 15.

It is thus possible to mount the pull-out box 3 on the extension slides 4, 5, insert the pull-out box 3 obliquely into the body 1, place the back edge of the shoulders 12 on the extension slides 4, 5 and then slide the tips 39 of the rearward directed ridges 38 from the front into the box 31 of the adapter 15 and the slot 32 of the adapter 16 until a stop is reached. At this stop position, part of the adapter 15 or 16 engages in the gap 40 so that the pull-out box 3 is latched to the adapters 15, 16 in the vertical direction. Said stop position is defined such that, when the front region of the pull-out box 3 is lowered in it, the rear one of the cross ribs 34 is inserted in the channel 29 of the adapter 13 or 14. When the cross rib 34 is inserted in the channel 29 as far as the stop, a drill hole 41 of the longitudinal rib 35 is aligned with drill holes 42 of the side walls 22 of the adapter 13 or of the side walls 25 of the adapter 14 so that, by inserting a pin in the drill holes 41, 42, the pull-out box 3 can be secured on the telescopic extension slides 4, 5.

Alternatively, it is possible to insert the forward facing ridges 37 of the obliquely placed pull-out box 3 from the rear into the slot 32 of the adapter 15 and into the box 31 of the adapter 16, causing the pull-out box 3 to be supported in a play-free manner on its left-hand side and in a play-retaining manner on the right-hand. When the front region of the pull-out box is lowered from this position, the front one of the cross ribs 34 engages with the channel 29 of the adapters 13, 14, and the longitudinal rib 35 drops down into the slot 28 of the adapter 13 and the niche 21 of the adapter 14. Here again locking is possible by means of pins inserted in aligned drill holes in the adapter and the longitudinal rib 35.

As may be clearly seen, one of the two cross ribs 34 and one of the two ridges 37, 38 can be omitted if only one of the two assembly methods depicted is required.

Figure 7:
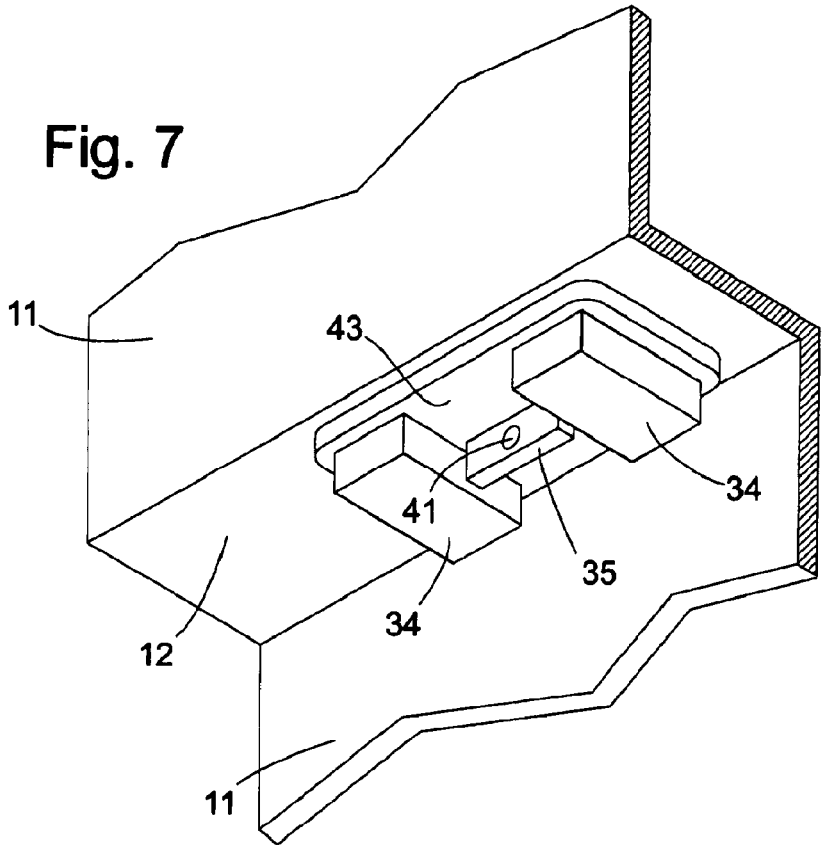
FIG. 7 is a variant of the detail of FIG. 5.

FIG. 7 shows a variant of the pull-out box 3 in a view analogous to FIG. 5. Here the two cross ribs 34 and the longitudinal rib 35 are formed on a molding 43 which is attached to the underside of the shoulder 12 in any suitable manner, e.g. by bonding, by snap-fitting into an opening or recess (not shown) of the shoulder 12, or the like. Such a multipart construction can simplify the manufacture of the pull-out box 3.

Figure 8:
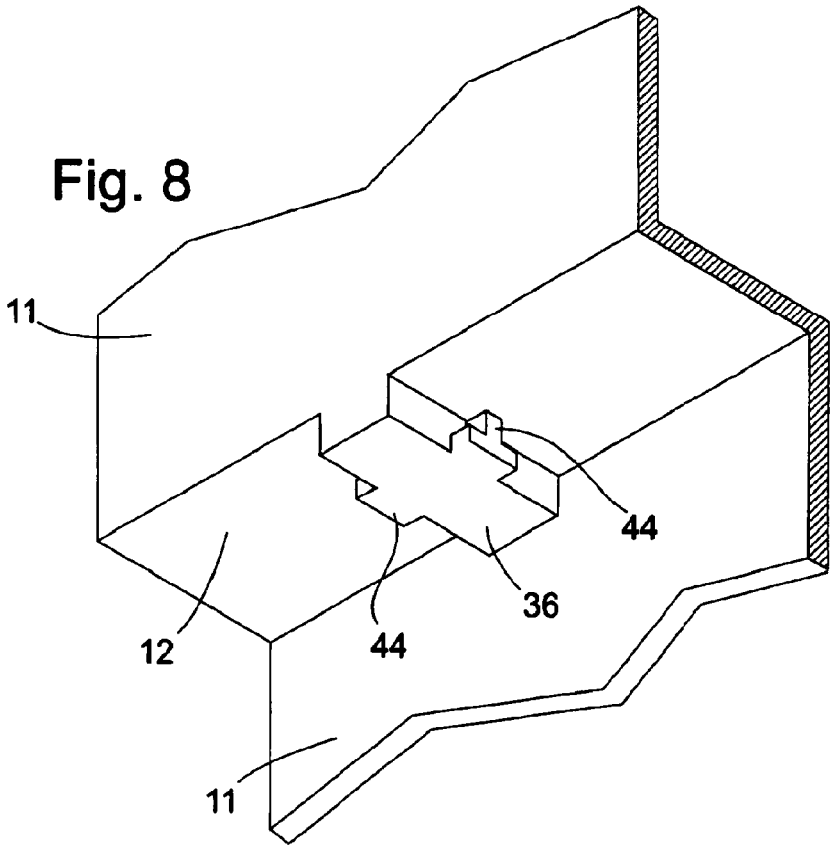
FIG. 8 is a variant of the detail of FIG. 6.

Another variant is shown in FIG. 8 in a view analogous to FIG. 6. In this variant, the elongated ridges 37, 38 shown in FIG. 6 are replaced by short projections 44 with T-shaped cross section. These projections 44 enable the pull-out box 3 to be mounted on two telescopic extension slides fitted with four identical adapters of the same design as the adapters 13, 14. As may be clearly seen, the T-shaped projections 44 engage in a play-retaining manner in the niche 21 of one adapter of the rear adapter pair and in a play-free manner in the slot 28 of the other adapter of said pair.

The invention claimed is:

1. A telescopic pull-out arrangement comprising:

one pair of telescopic extension slides;

another pair of telescopic extension slides, each of the one and the another pair of telescopic extension slides having a fixed rail and at least one movable rail;

a storage section; and at least one pair of adapters, the at least one pair of adapters being operable to assist in retaining the storage section on the movable rails of the one and the another pair of telescopic extension slides and the at least one pair of adapters including a given side adapter associated with the one pair of telescopic extension slides and an other side adapter associated with the another pair of telescopic extension slides, each of the given side adapter and the other side adapter has a first reciprocal contour and a second reciprocal contour, the storage section has a pair of engagement contours including a first engagement contour cooperatively engageable with the first reciprocal contour of a respective one of the given side adapter and the other side adapter and a second engagement contour cooperatively engageable with the second reciprocal contour of a respective one of the given side adapter and the other side adapter, the engagement of the storage section with the pair of adapters operating to secure the storage section to the movable rails of the one and the another pair of telescopic extension slides such that extension of the movable rails of the one and the another pair of telescopic extension slides along a pull-out direction correspondingly moves the storage section in the pull-out direction, the first engagement contour of the storage section is securable with the first reciprocal contour of the given side adapter and the second engagement contour of the storage section is securable with the second reciprocal contour of the other side adapter, and the engagement of the first engagement contour of the storage section with the first reciprocal contour of the given side adapter has less play in a transverse direction perpendicular to the pull-out direction than the engagement of the second engagement contour of the storage section with the second reciprocal contour of the other side adapter.

2. The telescopic pull-out arrangement as claimed in claim 1, wherein the first engagement contour of the storage section and the second engagement contour of the storage section are disposed mirror-symmetrically to one another in relation to a mirror plane parallel to the pull-out direction.

3. The telescopic pull-out arrangement as claimed in claim 1, wherein the first reciprocal contour and the second reciprocal contour of each one of the given side adapter and the other side adapter are disposed one behind the other on each adapter in the pull-out direction.

4. The telescopic pull-out arrangement as claimed in claim 1, wherein the first engagement contour of the storage section and the second engagement contour of the storage section are each configured as a projection and the first reciprocal contour and the second reciprocal contour of each one of the given side adapter and the other side adapter are configured as recesses of different width operable to accommodate one of the projections.

5. The telescopic pull-out arrangement as claimed in claim 4, wherein the front of the recess of the second reciprocal contour of each one of the given side adapter and the other side adapter has a lead-in chamfer.

6. The telescopic pull-out arrangement as claimed in claim 4, wherein the recesses into which the projection engages are each open in the pull-out direction.

7. The telescopic pull-out arrangement as claimed in claim 4, wherein the projection can be inserted in the recess of the first reciprocal contour of each one of the given side adapter and the other side adapter parallel to the pull-out direction and, in the inserted position, is latched in a vertical direction.

8. The telescopic pull-out arrangement as claimed in claim 7, wherein the latching is effected via engagement of the projection in an undercut of the recess.

9. The telescopic pull-out arrangement as claimed in claim 4, wherein the recesses are each open in a vertical direction.

10. The telescopic pull-out arrangement as claimed in claim 1, wherein the storage section has a further engagement contour and each one of the given side adapter and the other side adapter has a further reciprocal contour, the further engagement contour of the storage section and the further reciprocal contour of the given side adapter and the other side adapter cooperatively engaging one another for fixing the storage section and the adapters against one another in a movement direction of the movable rails.

11. The telescopic pull-out arrangement as claimed in claim 10, wherein the further reciprocal contour of each of the given side adapter and the other side adapter is disposed on the adapter between the first reciprocal contour and the second reciprocal contour of the respective given side adapter or other side adapter.

12. The telescopic pull-out arrangement as claimed in claim 11, wherein the first reciprocal contour and the second reciprocal contour of each one of the given side adapter and the other side adapter and the further reciprocal of the respective adapter are formed in one piece on the adapter.

13. The telescopic pull-out arrangement as claimed in claim 4, wherein the first reciprocal contour and the second reciprocal contour of each one of the given side adapter and the other side adapter are formed in one piece on the respective adapter.

14. The telescopic pull-out arrangement as claimed in claim 10, wherein the further reciprocal of each respective adapter is configured on the adapter as a channel running transversely to the movable rail.

15. The telescopic pull-out arrangement as claimed in claim 1, wherein each of the telescopic extension slides is fitted with two adapters, of which every two adapters are disposed opposite one another on the telescopic extension slide pairs, wherein in the case of one of the two adapters a third engagement contour and in the case of the other adapter a fourth engagement contour is disposed in advance in the pull-out direction of the movable rail.

16. The telescopic pull-out arrangement as claimed in claim 1, wherein each of the telescopic extension slides is fitted with a first adapter and a second adapter, wherein the first adapter precedes the second adapter in the pull-out direction of the telescopic extension slides and the first adapter is disposed in advance of one of the engagement contours and the second adapter is disposed in advance of another one of the engagement contours.

17. The telescopic extension slide arrangement as claimed in claim 10, wherein one engagement contour is configured as a T-slot block on the storage section.

18. The telescopic pull-out arrangement as claimed in claim 14, wherein one engagement contour is configured as a T-slot block on the storage section and the channel and the T-slot block can be assembled at least largely in a play-free manner in the movement direction of the movable rail.

19. The telescopic pull-out arrangement as claimed in claim 1, wherein the adapters are configured as an angle section with angle legs of unequal length, of which the longer angle leg is fixed to the longer side wall of the movable rail, while the shorter angle leg lies on the shorter side wall located above in an installed position of the movable rail.

20. The telescopic pull-out arrangement as claimed in claim 1, wherein the storage section includes a main body extending between the telescopic extension slides and, fixed to the main body, moldings on which the first engagement contour of the storage section and the second engagement contour of the storage section are formed.

21. A retaining device comprising:

a telescopic pull-out arrangement having one pair of telescopic extension slides, another pair of telescopic extension slides, each of the one and the another pair of telescopic extension slides having a fixed rail and at least one movable rail, a storage section, and at least one pair of adapters, the at least one pair of adapters being operable to assist in retaining the storage section on the movable rails of the one and the another pair of telescopic extension slides and the at least one pair of adapters including a given side adapter associated with the one pair of telescopic extension slides and an other side adapter associated with the another pair of telescopic extension slides, each of the given side adapter and the other side adapter has a first reciprocal contour and a second reciprocal contour, the storage section has a pair of engagement contours including a first engagement contour cooperatively engageable with the first reciprocal contour of a respective one of the given side adapter and the other side adapter and a second engagement contour cooperatively engageable with the second reciprocal contour of a respective one of the given side adapter and the other side adapter, the engagement of the storage section with the pair of adapters operating to secure the storage section to the movable rails of the one and the another pair of telescopic extension slides such that extension of the movable rails of the one and the another pair of telescopic extension slides along a pull-out direction correspondingly moves the storage section in the pull-out direction, the first engagement contour of the storage section is securable with the first reciprocal contour of the given side adapter and the second engagement contour of the storage section is securable with the second reciprocal contour of the other side adapter, and the engagement of the first engagement contour of the storage section with the first reciprocal contour of the given side adapter has less play in a transverse direction perpendicular to the pull-out direction than the engagement of the second engagement contour of the storage section with the second reciprocal contour of the other side adapter.

* * * * *